US006085996A

United States Patent [19]

Culbertson et al.

[11] Patent Number: 6,085,996

[45] Date of Patent: Jul. 11, 2000

[54] TWO-PIECE SPRAY NOZZLE

[75] Inventors: Samuel William Culbertson, Boulder; Robert Ray Mellette, Nederland, both of Colo.

[73] Assignee: Coating Atomization Technologies, LLC, Boulder, Colo.

[21] Appl. No.: 09/264,157

[22] Filed: Mar. 5, 1999

Related U.S. Application Data

[60] Provisional application No. 60/076,952, Mar. 5, 1998.

[51] Int. Cl.[7] ..... B05B 1/28

[52] U.S. Cl. ..... 239/290; 239/296; 239/390; 239/391; 239/591

[58] Field of Search ..... 239/290, 296, 239/390, 391, 396, 397, 436, 442, 591

[56] References Cited

U.S. PATENT DOCUMENTS

| | | | |
|---|---|---|---|
| 2,544,123 | 3/1951 | Andersson | 239/391 |
| 3,556,411 | 1/1971 | Nord et al. | 239/581 |
| 3,633,828 | 1/1972 | Larson | 239/412 |
| 3,698,646 | 10/1972 | Robba et al. | 239/591 |
| 3,791,579 | 2/1974 | Cowan | 239/3 |
| 4,232,824 | 11/1980 | Binoche | 239/296 X |
| 4,252,768 | 2/1981 | Perkins et al. | 264/332 |
| 4,335,851 | 6/1982 | Hastings | 239/3 |
| 4,349,947 | 9/1982 | Rood | 29/157 |
| 4,443,271 | 4/1984 | Goerss | 134/34 |
| 4,611,758 | 9/1986 | Geberth, Jr. | 239/119 |
| 4,702,420 | 10/1987 | Rath | 239/391 |
| 4,911,367 | 3/1990 | Lasley | 239/691 |
| 4,934,603 | 6/1990 | Lasley | 239/527 |
| 4,959,159 | 9/1990 | Mattson | 239/290 X |
| 5,180,104 | 1/1993 | Mellette | 239/296 X |
| 5,190,219 | 3/1993 | Copp, Jr. | 239/296 |
| 5,249,746 | 10/1993 | Kaneko et al. | 239/296 |
| 5,267,693 | 12/1993 | Dickey | 239/417.3 |
| 5,435,491 | 7/1995 | Sakuma | 239/296 |
| 5,494,226 | 2/1996 | Herstek et al. | 239/591 |

*Primary Examiner*—Andres Kashnikow
*Assistant Examiner*—Robin O. Evans
*Attorney, Agent, or Firm*—Sheridan Ross P.C.

[57] ABSTRACT

A fluid nozzle for an air assisted spray device is disclosed, wherein the fluid nozzle may have a nozzle tip therein which is more resistant to fluid abrasion than other portions of the fluid nozzle. In one embodiment, a plurality of nozzle tips are capable of being interchangeably used with a single main body of the fluid nozzle. Thus, replacement nozzle tips can be used when: (a) a nozzle tip effectiveness deteriorates due to wear, and (b) a fluid to be sprayed requires a nozzle tip with a different configuration. Further, in one embodiment, the fluid nozzle of the present invention provides an annular plenum between a recess wall of the main body, and an exterior portion of the nozzle tip. Such a plenum is used to enhance the volume and turbulence within an air chamber of the spray device prior to the air exiting for atomizing the fluid being sprayed. Thus, such enhanced turbulence provides a more uniform air velocity exiting the air chamber.

18 Claims, 4 Drawing Sheets

TWO-PIECE SPRAY NOZZLE

This application claims priority from U.S. provisional application Ser. No. 60/076,952, filed Mar. 5, 1998, and titled, "Two-Piece Spray Nozzle".

RELATED FIELD OF INVENTION

The present invention relates to a fluid nozzle for an air atomizing spray device, and in particular, a fluid nozzle having a nozzle tip that is more abrasion resistant than other portions of the fluid nozzle, and wherein the nozzle tip is recessed into a counter bore of the main body of the fluid nozzle so that a plenum is provided having an exterior portion of the nozzle tip as a wall of the plenum and a wall of the counter bore into the main body as another wall of the plenum.

BACKGROUND

For spraying a fluid with a typical air atomizing spray device, commonly referred to as "conventional air spray", or "high volume low pressure (HVLP) air spray," a fluid nozzle is attached to the device for atomizing the fluid with air that is also conveyed through the fluid nozzle. The tip of the fluid nozzle where the fluid exits the fluid nozzle is subject to more wear than the remainder of the fluid nozzle. In particular, this tip is subject to abrasive wear from the fluid being urged through a reduced size orifice when exiting the tip, and mechanical wear from a seating action with an internal spray device flow regulating needle. Accordingly, it is not uncommon for such a fluid nozzle to be deemed unusable when the nozzle tip interior deteriorates sufficiently so that a flow regulating needle of the spraying device that is designed to seal the nozzle tip and thereby prevent the fluid from exiting cannot sealingly mate with the interior of the nozzle tip due to the wear thereof. This circumstance is unfortunate due to the fact that such nozzle tips have relatively simple configurations in comparison to the remainder of the fluid nozzle. Said differently, the remainder of the fluid nozzle is substantially more expensive to manufacture in that it must precisely fit with the spray device both for receiving the fluid to be sprayed and for receiving pressurized air through a plurality of air passageways machined through the fluid nozzle. Accordingly, it would be advantageous to have a fluid nozzle wherein the fluid nozzle tip is composed at least partially of a more abrasive resistant material so that the useful life of the fluid nozzle is extended. Moreover, since enhanced abrasive resistant materials increase fluid nozzle manufacturing costs, it would also be advantageous to use such abrasion resistant materials only on the nozzle tip rather than the entire fluid nozzle.

Additionally, it is not uncommon for differently configured fluid nozzles to be used to thereby account for different viscosities and flow characteristics of fluids to be sprayed. Moreover, such different configurations are substantially only needed in the nozzle tip portion of the fluid nozzle. Thus, it would be also advantageous to have a fluid nozzle for air atomizing spraying, wherein the nozzle tip is able to be interchanged with nozzle tips having a different configuration such as a different sized fluid exit orifice and/or a nozzle tip having a different length or diameter extending outwardly from a main body of the fluid nozzle.

The above mentioned desired advantages are provided by the novel fluid nozzle described in the sections herein below.

SUMMARY

The present invention is a novel fluid nozzle for an air atomizing fluid spray device. The fluid nozzle has a central fluid passageway therethrough. A first end of the central fluid passageway extends through a main body of the fluid nozzle and aligns with a fluid passageway of the spray device for receiving a pressurized fluid therefrom. A second (i.e., opposite) end of the central passageway has a restricted diameter orifice, where the pressurized fluid is ejected from both the fluid nozzle and the spray device. In one aspect of the present invention, a replaceable tip for the fluid nozzle is provided. In particular, the replaceable tip provides the following advantages:

(a) since the nozzle tip experiences the most wear during spraying, replacing the nozzle tip rather than the entire fluid nozzle substantially reduces the cost of parts for spraying in that a substantial expense is incurred in the manufacturing the main body of the fluid nozzle and this main body experiences little wear during spraying;

(b) the nozzle tip may be replaced with a differently shaped tip for spraying a fluid having a different viscosity and/or flow characteristics.

Moreover, in another aspect of the present invention, the nozzle tip may include a wear resistant material within the interior of the nozzle tip that is most subject to wear. That is, since the interior of the central fluid passageway through the nozzle tip is shaped so as to sealingly seat with a fluid flow regulating needle also within the central fluid passageway, the flow of the fluid through the nozzle tip ceases when the fluid flow regulating needle seats against an annular seating portion of the nozzle tip interior. However, the seating portion is subjected to more wear than other portions of the fluid nozzle. Thus, at least the seating portion surface may be composed of a substantially more abrasion resistant material than other portions of the central passageway interior surface. In particular, the abrasion resistant material may be a hardness value of 40 or greater on the Rockwell C hardness scale. Accordingly, the following are representative of such enhanced abrasion resistant materials: 17-4 PH stainless steel, 440 C stainless steel, tungsten carbide, or A2 tool steel. Thus the other portions of the central passageway interior (and in some embodiments, substantially the entire remainder of the fluid nozzle) may be composed of a less abrasion resistant material such as 303 stainless steel, 1018 carbon steel, 12L14 free-machining steel, Acetel plastic resin, or an aluminum alloy. Thus, in comparison to prior art fluid nozzles manufactured entirely of, e.g., one of the less abrasive resistant materials above, the fluid nozzle of the present invention may be utilized for spraying more fluid before the seating portion is unable to fully seat with the fluid flow regulating needle to stop the fluid from leaking from the spray device.

Moreover, it is an aspect of the present invention that the abrasive resistant seating portion may be a component separately manufactured from the main body of the fluid nozzle. In one embodiment, this separate component may constitute the entire nozzle tip. In an alternative embodiment, the separate component may be only a portion of the nozzle tip, wherein the separate component is, e.g., an insert lining the interior of the nozzle tip. Further, note that the nozzle tip and its corresponding abrasion resistant separate component may be either fixedly attached to the main body of the fluid nozzle, or detachable for replacement with another nozzle tip.

The fluid nozzle of the present invention also includes a plurality of air passageways therethrough that provide jets of air for atomizing the fluid as it exits the fluid nozzle. Such air passageways have air exits distributed around the central fluid passageway for first pressurizing a chamber within an aircap of the spray device. Subsequently, the air escapes from the aircap via an aircap opening(s) adjacent to the fluid exiting nozzle tip orifice, and atomizes the fluid ejected from this nozzle tip. It is intended that the atomization result in as uniformly sized fluid droplets as possible, and that there is substantially no bias of the atomized fluid from, generally, the direction the fluid exits the nozzle tip. A typical prior art fluid nozzle can create areas of higher and lower pressures in the aircap opening(s), and consequently areas of higher and lower air velocities develop. This variation in velocity can have a deleterious affect on atomization quality since it is known that in air blast atomizing nozzles of this type, droplet size is, generally speaking, inversely proportional to the difference in velocity between the air and fluid streams. Thus it follows that variations in air velocity can result in a wider spread in fluid droplet sizes in the spray, which is to be avoided. The present invention seeks to minimize the variations in air velocity at the aircap opening(s) by increasing the volume and linear distance between the openings and the exit ends of the air passageways in the fluid nozzle body. This allows for the greater diffusion of the high velocity air stream exiting from the aircap opening(s) and more complete conversion of the localized kinetic (velocity) energy of the air stream into uniform potential (pressure) energy. Accordingly, any disruption or turbulence induced in the air stream by the geometry of the air passages prior to exiting the aircap will enhance this process. Thus, it is an aspect of the present invention that an annular plenum is provided having outside walls defined by a counterbore within the main body of the fluid nozzle, wherein the pressurized air exiting the air passageways first enters this plenum. Thus the plenum increases the volume for air within the aircap. Moreover, to enhance the air turbulence, the interior of the plenum is non-smoothly shaped, with protrusions and/or depressions. Such increases in the turbulence of the air induces a more uniform velocity of air exiting the aircap. Accordingly, a finer and/or more complete atomization of the fluid is provided when this air and the fluid come into contact.

In a typical embodiment of the present invention, wherein the nozzle tips are replaceable, an exterior surface of the nozzle tip provides the inner annular wall of the plenum, and by configuring this exterior surface so that it has, e.g., a bolt-like shape with a plurality of regularly spaced vertices between planar facets, such a configuration provides at least part of the plenum's non-smooth shape for facilitating both air turbulence, and also assisting in the attaching and detaching of the replaceable nozzle tips from the main body of the fluid nozzle. Moreover, it is important to note that such a plenum having the nozzle tip recessed within the main body counterbore defining the plenum's outside walls, substantially necessitates that the nozzle tip be separable (or at least separately manufactured) from the main body to cost effectively manufacture the fluid nozzles of the present invention.

Other features and benefits for the present invention will become evident from the detailed description and accompanying drawings herein.

DETAILED DESCRIPTION

Figure 1B:
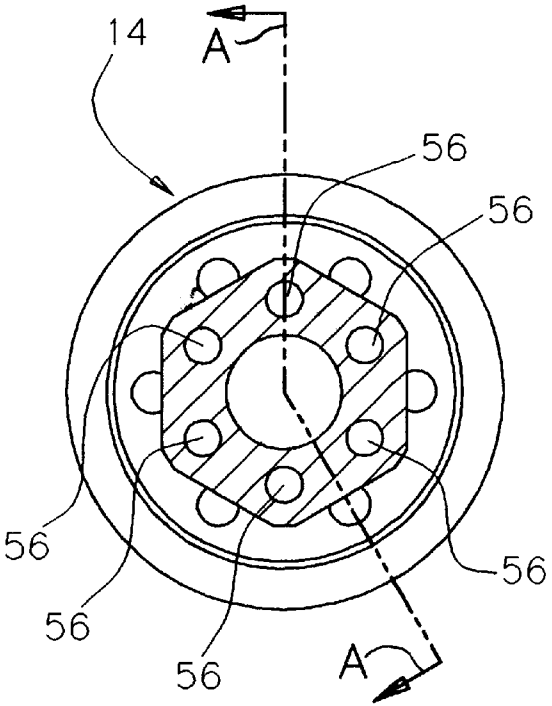
FIG. 1B is also a cross-sectional view of the fluid nozzle 10, wherein the air passageways 56 are shown. Note that this cross-sectional view is along the sectioning plane labeled "B" in FIG. 1A.
Figure 1A:
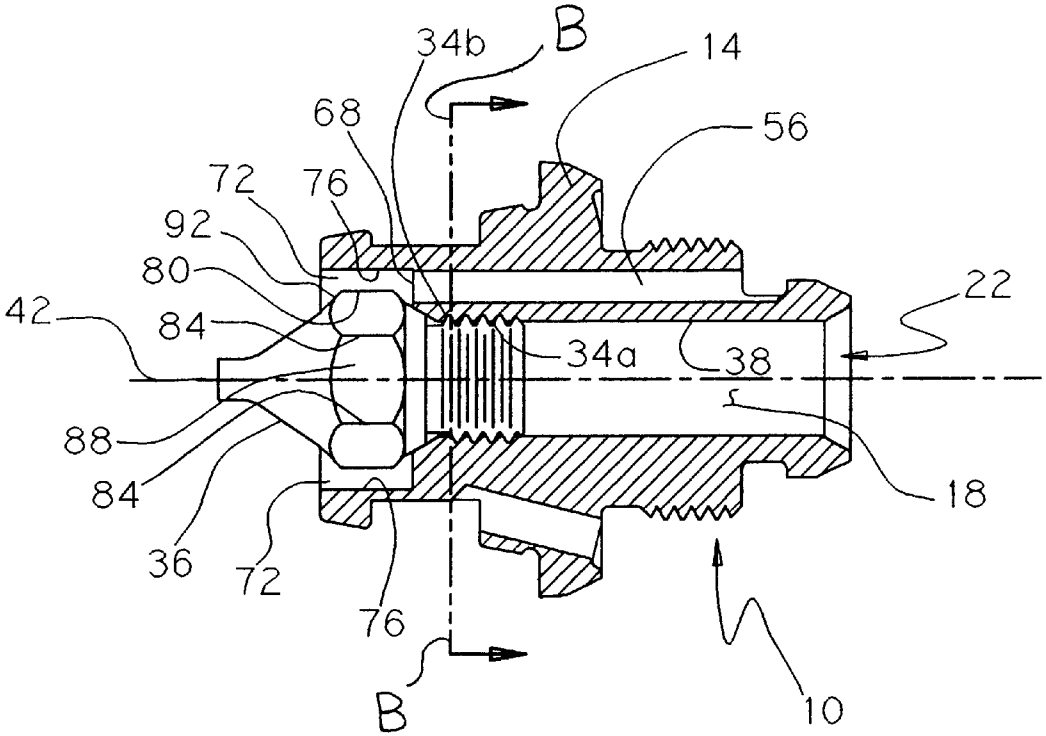
FIG. 1A is a partial cross-sectional view of the fluid nozzle 10 of the present invention, wherein the sectioning planes are labeled as "A" in FIG. 1B.
Figure 2A:
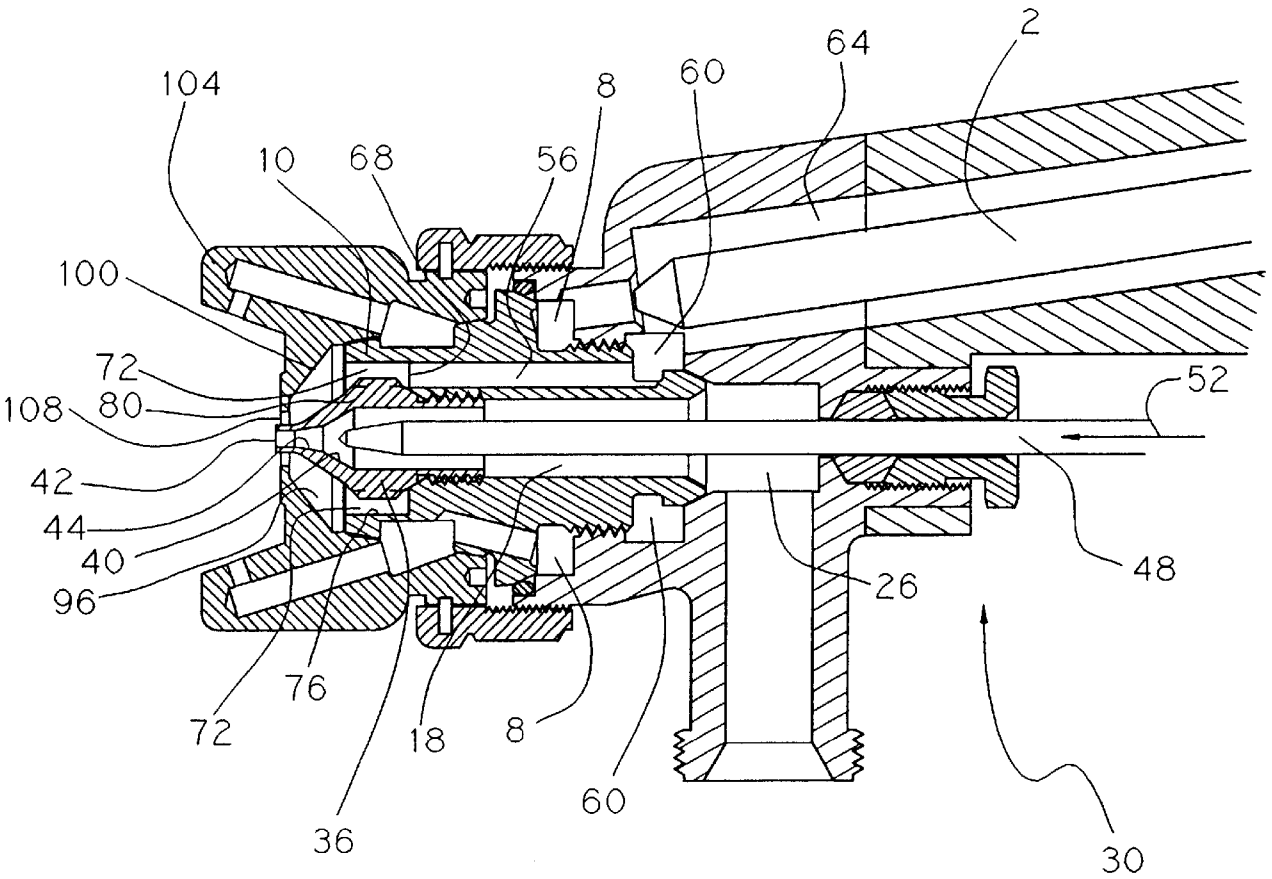
FIG. 2A is a cross-sectional view of the fluid nozzle 10 provided with an air atomizing spray gun 30.
Figure 2B:
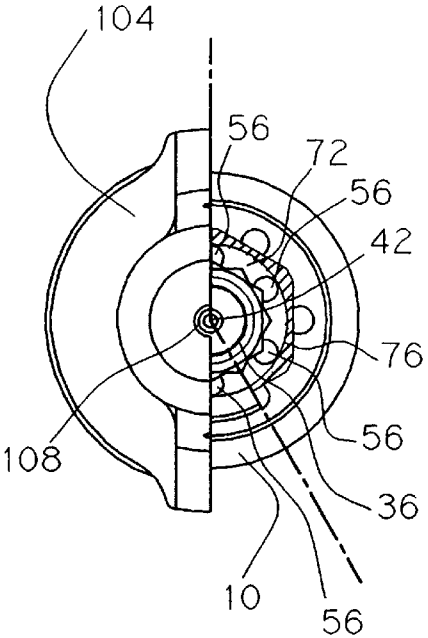
FIG. 2B provides a partial cross-sectional view of the end of the spray gun 30 illustrating the alignment of the fluid nozzle 10 within this spray gun and showing the annular plenum chamber 72.

FIG. 1A illustrates a fluid nozzle 10 of the present invention. The fluid nozzle 10 includes a main body 14 (displayed in cross-section in the present figure) that comprises the bulk of the fluid nozzle. The main body 14 has a central passageway 18 therethrough, wherein a first end 22 engages a fluid providing channel 26 (FIG. 2A) for receiving a fluid to be sprayed from the spray device such as spray gun 30 (FIG. 2A). At the opposite end of the central fluid passageway 18, a fluid nozzle tip 36 is threadably secured within the passageway 18 via mating threads 34*a* (on the nozzle tip) and 34*b* (on the central passageway 18 interior surface 38).

Figure 4:
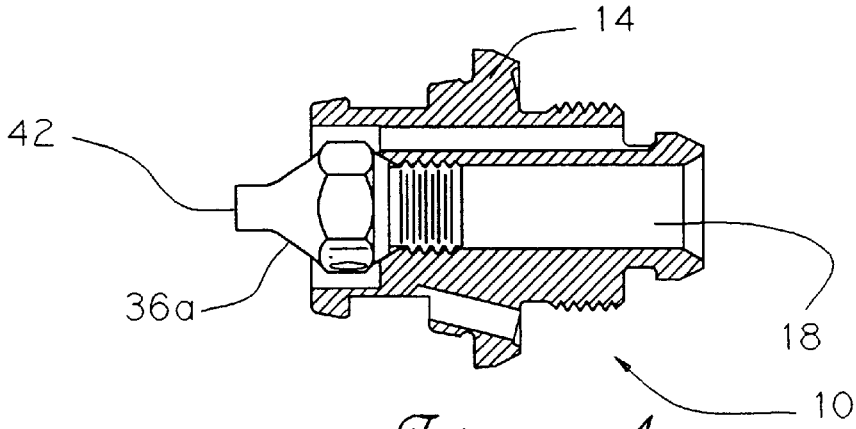
FIG. 4 shows another embodiment of the fluid nozzle 10, wherein the nozzle tip 36*a* has a wider diameter orifice 42 than the nozzle tip 36 shown in FIG. 1A.
Figure 5:
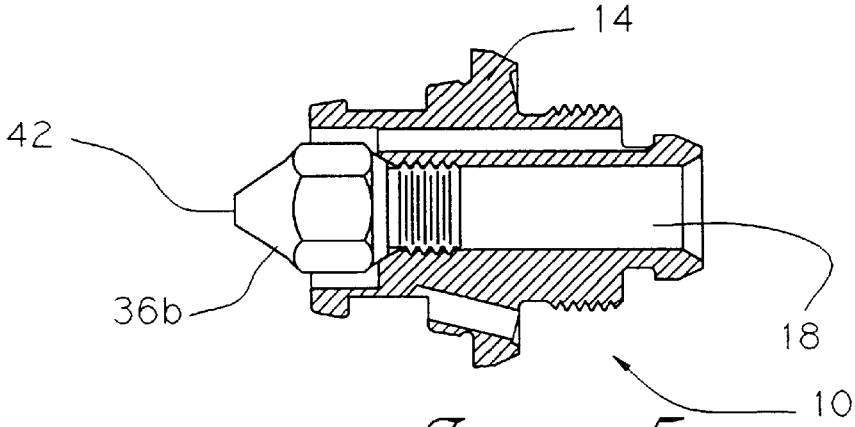
FIG. 5 is another embodiment of the fluid nozzle 10, wherein a nozzle tip 36*b* has a truncated orifice 42 geometry.

As shown in the nozzle tip 36 cross-section of FIG. 2A, the central passageway 18 extends through the nozzle tip 36 with the central passageway 18 having a tapered portion 40 toward the fluid ejecting orifice 42. The tapered portion 40 includes a seating portion 44 for seating with the fluid flow regulating needle 48 when the needle moves in the direction of arrow 52. Note that in the present embodiment, the nozzle tip 36 is replaceable within the main body 14 by unthreading the mating threads 34*a* and 34*b* and thereby replacing the nozzle tip 36 with e.g., a different such tip. For example, FIGS. 4 and 5 show nozzle tips 36*a* and 36*b*, respectively, attached to the same main body 14 as in FIG. 1A. Thus, the ability to interchange nozzle tips 36 allows fluids of different viscosities and/or flow characteristics to be sprayed with the same main body 14. Moreover, by changing to a nozzle tip 36 having a different exterior configuration, (e.g., length in the direction of arrow 52, an outside diameter of the orifice 42, and/or an inside diameter of the orifice 42) the fluid nozzle of the present invention may be used with a variety of spray guns 30 (FIG. 2A) having differently shaped air caps 104 (FIG. 2A) as one skilled in the art will understand. Moreover, note that the nozzle tip 36 of the present embodiment is entirely composed of a more abrasive resistant material than the material(s) composing the main body 14. In particular, note that the more abrasive resistant material may have a Rockwell C hardness of 40 or more. An exemplary list of materials for both the more abrasive resistant material (and more expensive), and the less abrasive resistant material(s) (and less expensive) are provided in the summary section hereinabove.

The fluid nozzle 10 of the present embodiment also includes a plurality (e.g., six) of air passageways 56 that are distributed around the fluid central passageway 18. Note that only one such passageway is shown in FIGS. 1A and 2A. However, FIG. 1B shows all six air passageways 56. The air passageways 56 receive pressurized air from an annular chamber 60 (shown in cross section in FIG. 2A), which in turn receives such air from the spray gun 30 air chamber 64, as one skilled in the art will understand. Additionally note it within the scope of the present invention to include embodiments with more or fewer air passageways 56.

Each of the air passageways 56 has an open end 68 (one of which is shown in FIG. 2A) for supplying pressurized air to an annular plenum 72 that has: (a) an exterior annular wall 76 provided by a counterbore within the main body 14, and (b) an interior annular wall 80 which is part of the exterior surface of the nozzle tip 36. In particular, regarding the interior wall 80, note that it has a bolt-like shape with a plurality of vertices 84 (e.g., 6 or 12) and substantially planar surfaces 88 therebetween. Moreover, note that the interior wall 80 projects into the plenum 72 via wall sections 92. Accordingly, it is believed that such a non-smooth configuration of the inner wall 80 tends to induce turbulence in the pressurized air exiting the air passageways 56.

Applicant believes that the increased turbulence of the pressurized air enhances the air turbulence in the air chamber 96 which is between: (a) the recess 100 of the air cap 104 that substantially covers the fluid nozzle 10, and (b) the fluid nozzle 10. Further, the increase in volume of the air chamber 96 due to the plenum 72 volume is believed to generate a more uniform air velocity exiting the annular opening 108 surrounding the fluid ejecting orifice 42. Thus, the pressurized air exiting the opening 108 tends to provide finer and more uniform atomization of the fluid exiting the orifice 42.

Figure 3:
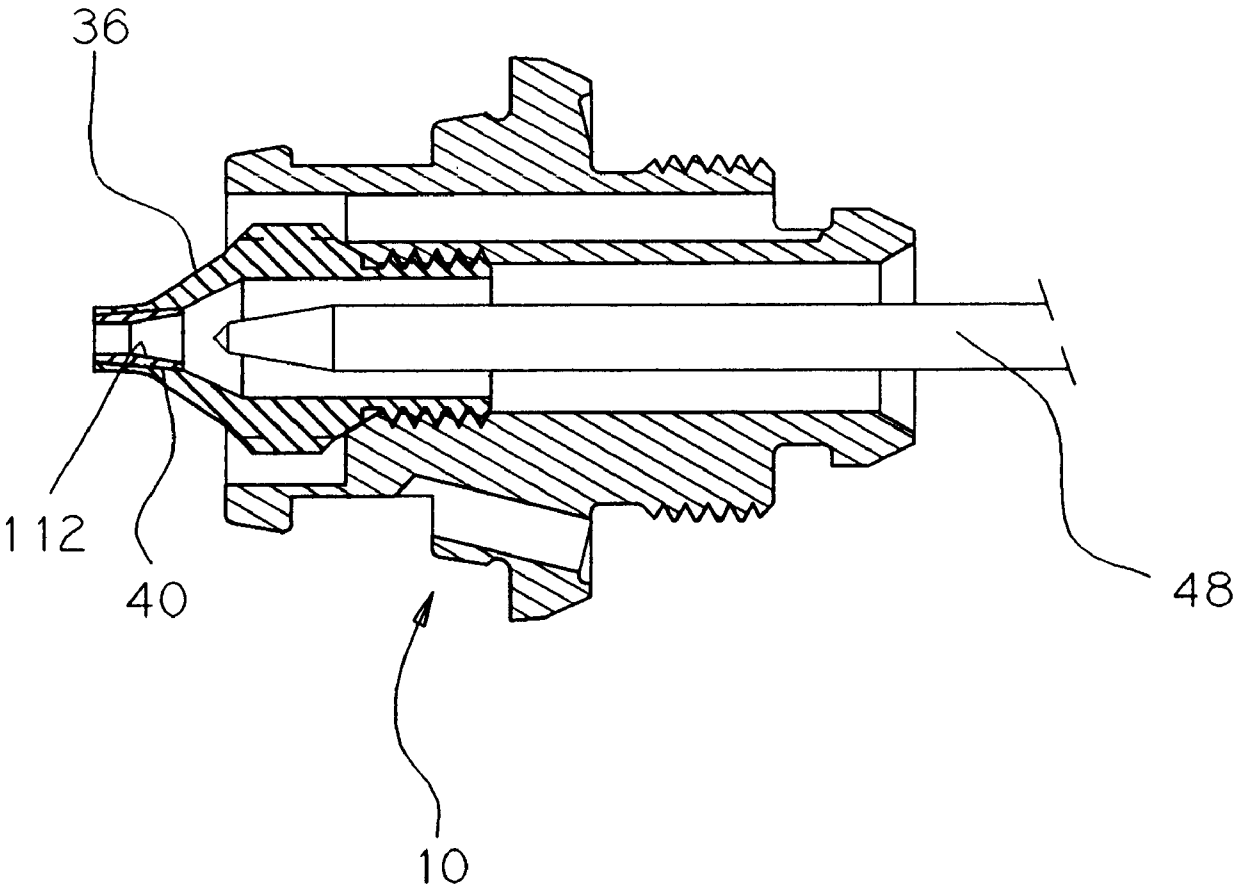
FIG. 3 is a cross-sectional view of another embodiment of the fluid nozzle 10, wherein an abrasion resistant insert 112 is provided in the interior of the fluid nozzle tip 36.

FIG. 3 shows another embodiment of the fluid nozzle 10, wherein instead of the entire replaceable nozzle tip 36 being composed of a more abrasive resistant material, an insert 112 is secured in the tapered portion 40 so that the seating portion 48 has a surface composed of the more abrasive resistant material.

Moreover it is also within the scope of the present invention to fixedly secure a nozzle tip 36 having an abrasive resistant interior to the main body 14 by, e.g., press fitting the nozzle tip into the fluid exiting end of the central passageway 18.

Figure 6:
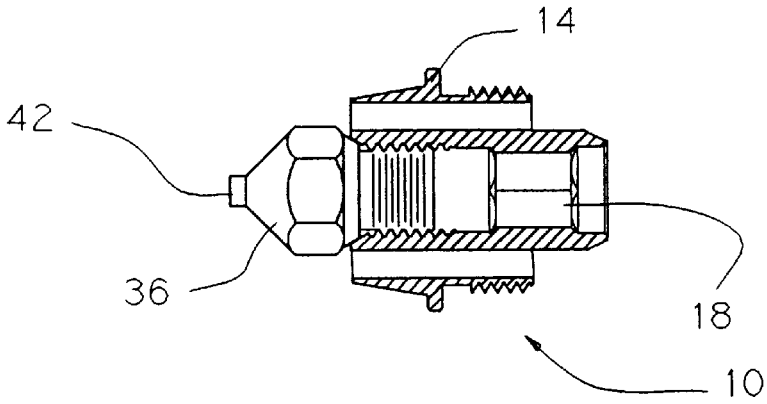
FIG. 6 is another embodiment of the fluid nozzle 10, wherein a replaceable nozzle tip 36 is provided without the annular plenum chamber.

Additionally, it is within the scope of the present invention that the replaceable nozzle tip may be provided without the plenum 72. In particular, such an embodiment is illustrated in FIG. 6.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A fluid nozzle for a fluid spraying device that supplies a fluid and pressurized air to said fluid nozzle for atomizing and ejecting the fluid as a spray, comprising:

a main body that removably attaches to the spray device, said main body having a fluid passageway with first and second ends, and an air passageway with first and second ends, wherein the first fluid passageway end aligns with a fluid passageway of the spray device for fluid communication, and said air passageway first end aligns with an air passageway of the spray device for air communication;

a first nozzle tip operatively connected to said main body wherein said first nozzle tip has a fluid channel there through, said first fluid channel providing fluid flow between said fluid passageway second end and a reduced size first orifice of said first nozzle tip for ejecting the fluid from the first nozzle tip, said first nozzle tip further including a portion for releasably securing said first nozzle tip to said main body, and a first seating portion within said channel for seating with a fluid flow regulating needle of the spray device;

wherein said reduced size first orifice is positioned so that the ejected fluid is atomized by an airflow that has exited said fluid nozzle via the second end of the air passageway; and wherein said first fluid channel includes at least a surface substantially more resistant to abrasion than a surface of said fluid passageway, wherein said atomizing air flow exits into a further annular passage formed between said main body and an air cap, said annular passage having an abrupt increase in cross sectional area so as to increase the turbulence of said air flow and to provide a more uniform air velocity exiting said air cap;

a second nozzle tip for attaching to said main body as a replacement for said first nozzle tip when said first nozzle tip is detached from said main body, said second nozzle tip having a second fluid channel there through, said second fluid channel providing fluid flow between said fluid passageway second end and a reduced size second orifice of said second nozzle tip for ejecting the fluid from the second nozzle tip; and a plurality of cylindrical passages axially arranged about the center axis of said main body through which atomizing air in fed therethrough and into an annular plenum chamber within said main body formed between an outer circumferential wall of said main body and said nozzle tip.

2. The fluid nozzle of claim 1, wherein said air flow exiting said fluid nozzle enters an air chamber between said fluid nozzle and an air cap of the spray device prior to atomizing the fluid.

3. The fluid nozzle of claim 1, wherein said abrasion resistant surface has a hardness value of 40 or greater on the Rockwell C hardness scale.

4. The fluid nozzle of claim 1, wherein said first fluid tip is manufactured from a material having a hardness value of 40 or greater on the Rockwell C hardness scale.

5. The fluid nozzle of claim 1, wherein said first nozzle tip includes threads that mate with corresponding threads of said main body for releasably securing said first nozzle tip to said main body.

6. The fluid nozzle of claim 1, wherein said second nozzle tip facilitates atomization of a particular fluid better than said first fluid nozzle.

7. The fluid nozzle of claim 6, wherein said second nozzle tip has at least one of:

(i) a fluid ejecting orifice, (ii) an outside diameter of the fluid ejecting orifice tip; and (iii) a length that is different from said first nozzle tip.

8. The fluid nozzle of claim 1, wherein one of said first and second nozzle tips includes an insert providing said abrasion resistant surface.

9. The fluid nozzle of claim 1, wherein the spray device includes a first air cap for use with said fluid nozzle when said first nozzle tip is attached thereto, and a different second air cap for use with said fluid nozzle when said second nozzle tip is attached thereto.

10. The fluid nozzle of claim 1, wherein an exterior portion of said first nozzle tip provides a wall for a plenum into which pressurized air exits said air passageway.

11. The fluid nozzle of claim 10, wherein said main body provides another wall of said plenum.

12. The fluid nozzle of claim 10, wherein said wall is non-smooth.

13. The fluid nozzle of claim 12, wherein said wall has a bolt-like shape.

14. The fluid nozzle of claim 10, wherein a plurality of said air passageways exit air into said plenum.

15. A fluid nozzle for a fluid spraying device that supplies a fluid and pressurized air to said fluid nozzle for atomizing and ejecting the fluid as a spray, comprising:

a main body that removably attaches to the spray device, said main body having a fluid passageway with first and second ends, and an air passageway with first and second ends, wherein the fluid passageway first end aligns with a fluid passageway of the spray device for fluid communication, and the air passageway first end aligns with an air passageway of the spray device for air communication;

a nozzle tip attached to said main body wherein said nozzle tip has a fluid channel there through, said fluid channel providing fluid flow between said fluid passageway second end and a reduced sized orifice of said nozzle tip for ejecting the fluid from the nozzle tip, said nozzle tip having an exterior portion wherein said second end of the air passageway provides pressurized air to a plenum, wherein said plenum has a first wall included in said main body and said exterior portion providing another wall to said plenum;

a plurality of cylindrical passages axially arranged about the center axis of said main body through which atomizing air is fed therethrough said into an annular plenum chamber within said main body formed between outer circumferential wall of said main body and said nozzle tip;

wherein said reduced sized orifice is positioned so that the ejected fluid is atomized by an air flow that has exited both said plenum and an air chamber between an air cap for the spray device and said fluid nozzle and wherein said atomizing air flow exits into a further annular passage formed between said main body and said air cap, said annular passage having abrupt increase in cross sectional area so as to increase the turbulence of said air flow and to provide a more uniform air velocity exiting said air cap.

16. A fluid nozzle as claimed in claim 15, wherein said exterior portion of the nozzle tip has a non-smooth surface for enhancing a turbulence of the pressurized air exiting said first air passageway.

17. A fluid nozzle as claimed in claim 15, wherein said main body includes a plurality of said air passageways, each said air passageway having an air exiting end for providing air to said plenum.

18. A fluid nozzle for a fluid spraying device that supplies a fluid and pressurized air to said fluid nozzle for atomizing and ejecting the fluid as a spray, comprising:

a main body that removably attaches to the spray device, said main body having a fluid passageway with first and second ends, and a plurality of air passageways, wherein each said air passageway has corresponding first and second ends wherein each said air passageway first end aligns with an air passageway of the spray device for air communication, and each said air passageway second end provides air to an air chamber between an air cap of the spray device and said fluid nozzle;

a nozzle lip fixedly attached to said main body wherein said nozzle tip has a fluid channel there through, said fluid channel providing fluid flow between said fluid passageway second end and a reduced size orifice of said nozzle tip for ejecting the fluid from the nozzle tip, said nozzle tip further including a seating portion within said channel for seating with a fluid flow regulating needle of the spray device;

a plurality of cylindrical passages axially arranged about the center axis of said main body through which atomizing air is fed therethrough and into an annular plenum chamber within said main body formed between an outer circumferential wall of said main body and said nozzle tip, wherein said reduced size orifice is positioned so that the ejected fluid is atomized by an air flow that has exited said fluid nozzle via the plurality of air passageways, and wherein said seating portion includes at least a surface substantially more resistant to abrasion than a surface of said fluid passageway, wherein said atomizing air flow exits into a further annular passage formed between said main body and said air cap, said annular passage having an abrupt increase in cross sectional area so as to increase the turbulence of said air flow and to provide a more uniform air velocity exiting said air cap.

* * * * *